United States Patent [19]

Day

[11] 4,227,724

[45] Oct. 14, 1980

[54] SECURITY BAR LOCK

[75] Inventor: Robert L. Day, Burbank, Calif.

[73] Assignee: S.D.S. Industries, Inc., Sun Valley, Calif.

[21] Appl. No.: 972,907

[22] Filed: Dec. 26, 1978

[51] Int. Cl.[2] ..... E05C 1/04

[52] U.S. Cl. ..... 292/145

[58] Field of Search ..... 292/137, 145, 147, 162, 292/189; 49/394

[56] References Cited

U.S. PATENT DOCUMENTS

| | | | |
|---|---|---|---|
| 1,758,263 | 5/1930 | Merz | 292/147 |
| 2,717,064 | 9/1955 | Hock | 49/394 |

*Primary Examiner*—Richard E. Moore

*Attorney, Agent, or Firm*—Flam & Flam

[57] ABSTRACT

A security bar lock for a door is neatly encased in an elongated section of trim molding. The bar lock projects behind the edge of the door and is retracted therefrom. A sturdy but compact fulcrum pin mounting transmits heavy forces to the frame structure itself.

14 Claims, 6 Drawing Figures

FIG. 4.
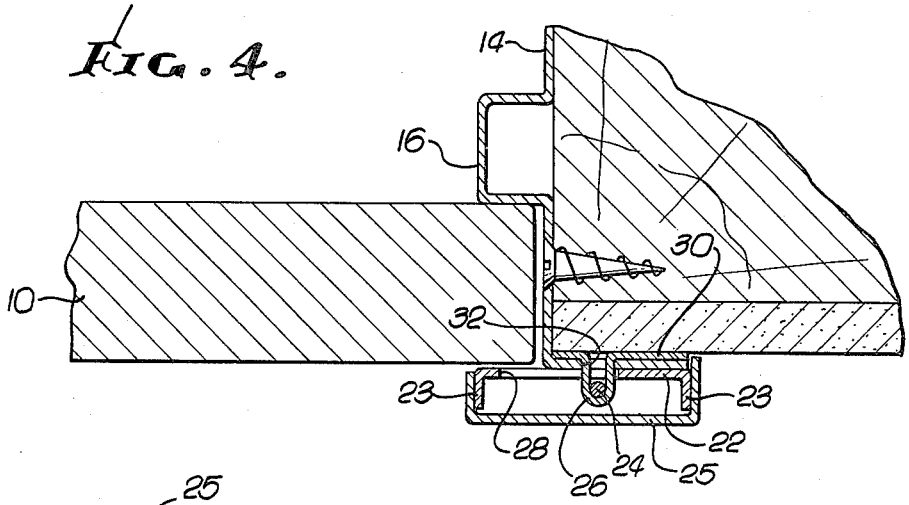
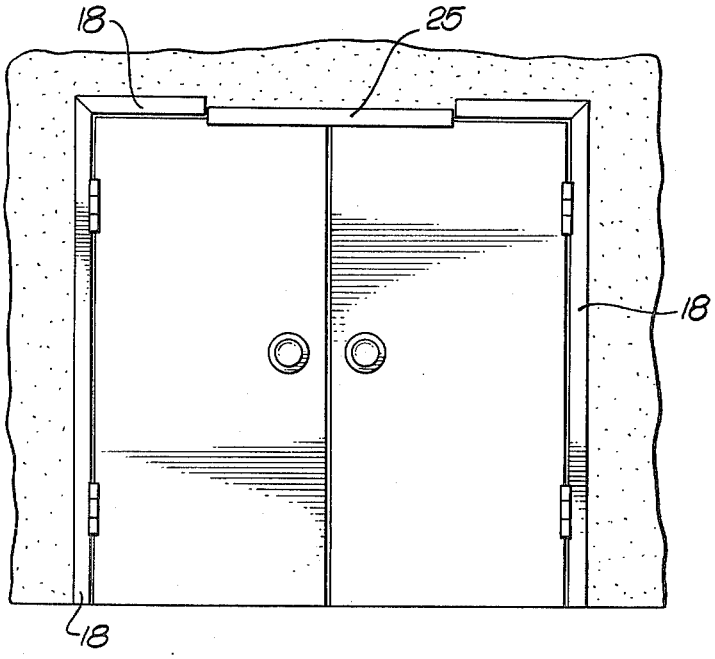
FIG. 5.
FIG. 6.
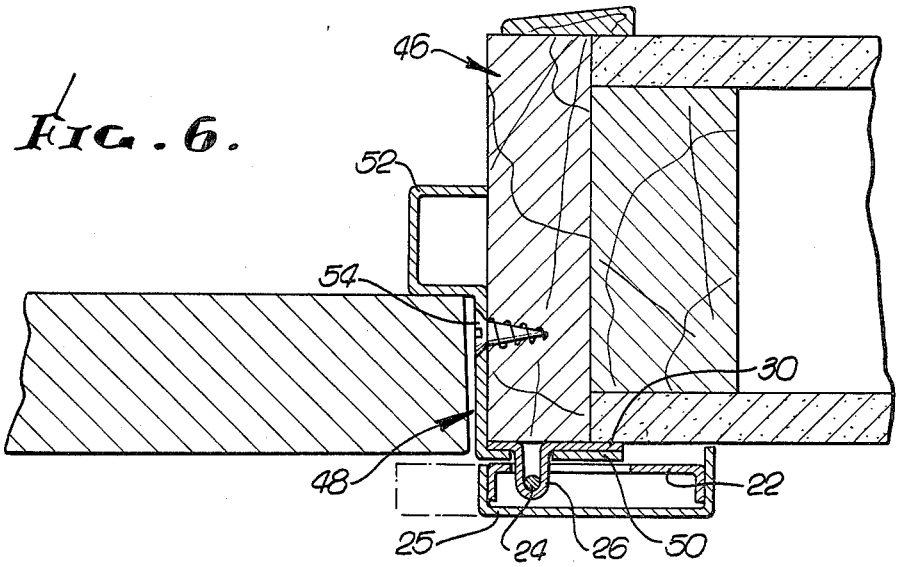

SECURITY BAR LOCK

FIELD OF INVENTION

This invention relates to security systems for doors, and particularly to a bar lock to stop the door from being opened when the primary door lock yields.

DISCUSSION OF PRIOR ART

A popular way for a burglar to open a door is to spread the door jambs apart, as by the aid of a conventional bumper jack, until the strike plate retracts from the latch bolt. Entry can yet be thwarted by a bar placed entirely across the door. While effective, such arrangement is highly cumbersome and unsightly.

OBJECTIVE

The primary object of this invention is to provide a new and improved bar lock for a door that is inconspicuous and simple to operate. A companion object of this invention is to provide a bar lock that is easily incorporated in a metal door frame construction.

SUMMARY OF INVENTION

In order to accomplish the foregoing objectives, I provide a bar lock made of relatively thin spring steel that slides over one edge of the door. The bar lock extends along a significant length of the door edge, thus preventing the build up of localized pressure that might cause some structure to yield following repeated impact. A unique cantilever mounting is provided for the bar lock. The entire mechanism is concealed in a molding or case that stimulates and thus complements the existing molding whereby the bar lock is neatly or camouflaged.

BRIEF DESCRIPTION OF THE DRAWINGS

A detailed description of the invention will be made with reference to the accompanying drawings wherein like numerals designate corresponding parts in the several figures. These drawings are all to scale.

FIG. 4 is a fragmentary horizontal sectional view taken along a plane corresponding to line 4—4 of FIG. 1.

FIG. 5 is an elevational view of a double door frame provided with a security bar lock.

FIG. 6 is a sectional view similar to FIG. 4, but illustrating a modified form of the present invention in which a conventional wooden door frame is provided with an attachment for mounting the security bar lock.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Structural and operational chracteristics attributed to forms of the invention first described shall also be attributed to forms later described, unless such characteristics are obviously inapplicable or unless specific exception is made.

Figure 1:
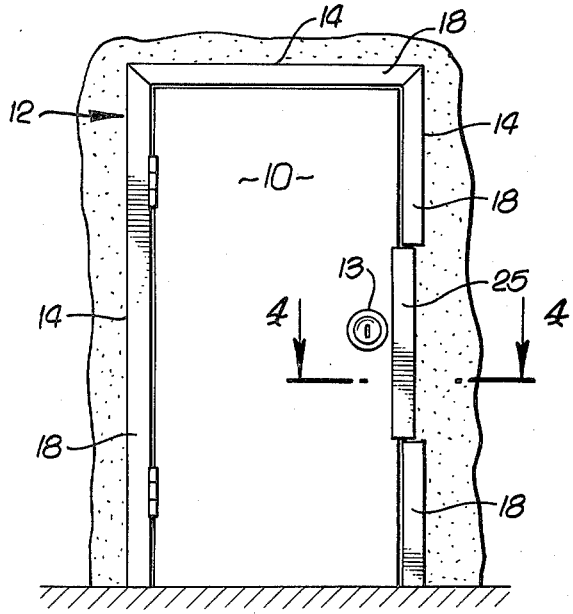
FIG. 1 is an elevational view of a metal door frame provided with a supplemental bar lock incorporating the present invention.

FIG. 1 illustrates a door 10 hinged along one vertical edge to a metal door frame structure 12. A coventional door lock 13 is located at the opposite or swinging edge of the door.

The door frame structure 12 in the present instance includes three frame parts 14 each generally of channel shaped configuration (FIG. 2) to fit around the edges of a wall opening. All of the frame parts are made of the same roll formed steel cut to suitable lengths to provide a header and two sides. An integral door stop 16 is formed in the central web of frame parts. A door frame structure of this general character is shown in my U.S.A. Pat. No. 4,020,544.

Metal door frame structures typically include metal trim molding 18 that snaps into place over clips (not shown) formed on the side flanges 20 of the door frame parts. The frame flanges 20 on the inside of the door opening are substantially flush with the door. On the inside of the door opening and at a place past which the edge of the door swings, a section of the trim molding 18 is removed. At this location, an elongated bar lock 22 is positioned. It has a flat plate part that contracts the door frame flange 20. The bar lock is made of spring steel with edges 23 turned up to provide a continuous clip for snap attachment of a supplemental trim molding section 25 that has an external appearance identical to the trim molding 18. Preferably the section 25 is in all respects identical to the molding 18.

Figure 2:
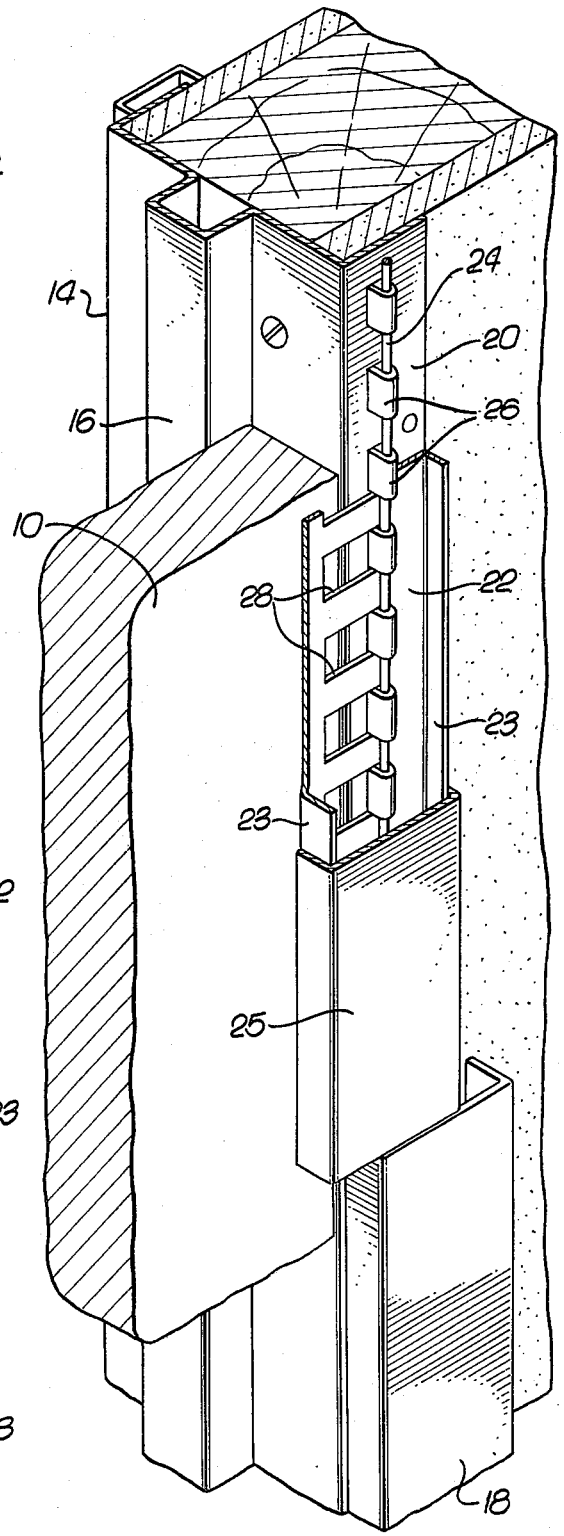
FIG. 2 is an enlarged isometric view of the door frame and bar lock, part of the apparatus being broken away and shown in section.
Figure 3:
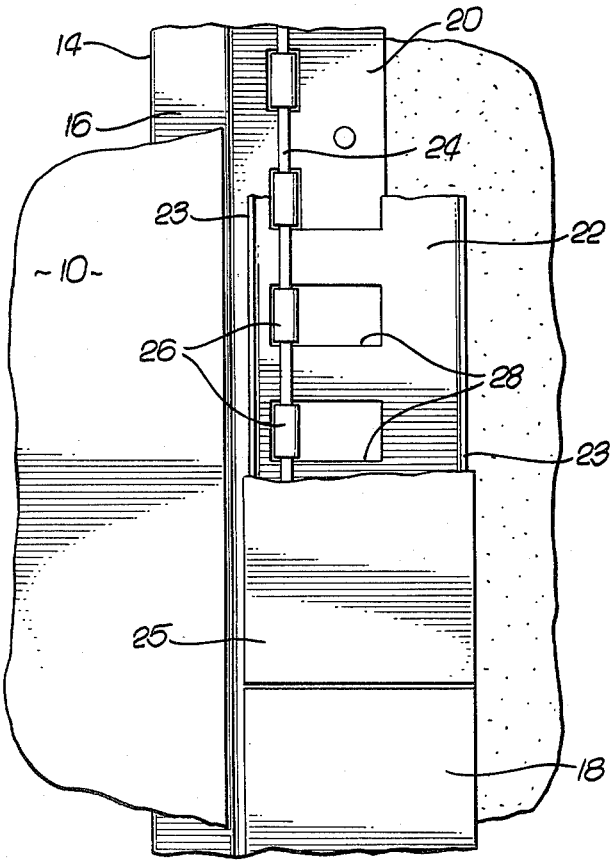
FIG. 3 is an enlarged fragmentary front elevational view of the bar lock shown in retracted position, part of the apparatus being broken away and shown in section.

The bar lock 22 slides along the frame flange 20 either to project over the edge of the door, as shown in FIG. 2, or to retract to clear it (FIG. 3). The bar lock is confined for sliding movement by the aid of a fulcrum rod, strip or pin 24 that closely overlies the flange 20 in spaced parallel relationship thereto. The narrow space between the pin and the frame flange 20 just corresponds to the thickness of the bar lock 22. Preferably, a slight negative clearance provides a yielding antirattle spring restraint.

The bar lock 22 is confined for movement at right angles to the frame and door edge by the aid of a series of longitudinally arrayed guide posts 26. The posts 26 project from the flange 20 and through corresponding longitudinally arrayed rectangular slots 28 in the bar lock 22. The guide posts serve an additional function, namely, of mounting the fulcrum pin 24. For this purpose, the posts 26 are in the form of hollow knuckles all struck from a common backing plate 30 (FIG. 4). The backing plate extends behind the flange 20. The flange 20 has holes 32 to allow the posts 26 to project frontally of the frame. The fulcrum pin 24 extends through aligned openings of the posts or knuckles 26 and locks the backing plate 30 in place. An end of the pin (not shown) is crimped or otherwise mutilated in order to lock the pin against axial movement. The posts 26, pin 24 and the apertured bar lock are all concealed behind the supplemental trim section 25. Instead of a backing plate 30, knuckles could be formed by lancing and curling the flange 20.

In order to project the bar lock 22, it is merely necessary to engage the trim 25 with the fingers to move it into overlying relationship with respect to the door edge. The amount of movement corresponds to the free lengths of the slots 28. The overlap exceeds by a reasonable percentage, the throw of the retractable latch of the lock 13. Accordingly, if the door frames are bowed apart sufficiently to disengage the retractable latch of the lock 13, the edge of the door is yet well behind the edge of the bar lock 22.

The bar lock, made of spring steel, resists heavy forces tending to open it. The spring steel characteristic ensures that the stress imposed on the bar lock distributes evenly over the entire length of the fulcrum pin, whereby localized rupture or failure under impact does not occur. The forces are distributed and transmitted through the fulcrum pin 24 to the frame.

The unauthorized person ordinarily will be discouraged by the fact that the door does not yield notwithstanding the fact that the main lock 13 is opened or has been disabled. The supplemental security bar lock 20 may or may not be seen past the door stop 16. If it is, the bar lock offers no projection by the aid of which a simple tool can retract it. A tool inserted into one of the slots 28, even if accessible, will accomplish nothing.

When extra security is not required, the entire mechanism neatly retracts and is inconspicuous as it conforms to the adjacent trim molding. The bar lock may be located at the top edge of the door rather than at the side. Such an arrangement is required in order to secure a double door, as is illustrated in FIG. 5.

DESCRIPTION OF ALTERNATIVE EMBODIMENT

In the form of the invention shown in FIG. 6, the door frame structure comprises two parts: one, conventional wooden frame elements 46, and two, an elongaged roll formed metal section 48 that provides a sturdy inside mounting flange 50 for the bar lock 22 and the backing plate 30.

The metal section 48 converts the conventional wooden frame structure for use with a supplemental bar lock 22. The section 48 is angled to fit around the inside corner of the appropriate frame element 46. In the present instance, the metal section 48 also provides a door stop 52, replacing the conventional wooden one. The supplemental door frame section 48 is attached by screws 54 or other suitable means inaccessible from the outside of the closed door.

Intending to claim all novel, useful and unobvious features shown or described, I make the following claims:

1. In an apparatus for securing against entry by an unauthorized person, a building door hinged on one side of a door opening:

(a) a door frame structure providing a flange faced to the inside of the door opening and located at a place past which the edge of the door swings;

(b) an elongated bar lock;

(c) means mounting the bar lock on said flange so that the bar lock substantially parallels the adjacent edge of the door opening;

(d) said mounting means confining the bar lock for sliding movement substantially parallel to the plane of the door opening to project throughout its length over the said edge of the door and to retract to clear it;

(e) said mounting means transmitting door opening pressure exerted on said bar lock to said frame structure; and (f) means determining stable open and closed positions of said bar lock.

2. The apparatus as set forth in claim 1 in which said door frame structure is part of a channel formed to fit about the door opening.

3. The apparatus as set forth in claim 1 in which said door frame structure is an attachment adapted to be secured to an existing door frame.

4. In an apparatus for securing against unauthorized entry, a door hinged on one side of a door opening:

(a) a door frame structure providing a flange faced to the inside of the door opening;

(b) an elongated bar lock extending along the flange at a place past which the edge of the door swings;

(c) means confining the bar lock for sliding movement substantially at right angles to the frame structure to project over the said edge of the door and to retract to clear it;

(d) said confining means transmitting pressure exerted on said bar lock to said frame structure;

(e) said bar lock including a plate in face to face contact with said flange;

(f) said confining means including an elongated fulcrum member secured in spaced parallel relationship along said flange, and providing a space through which said bar lock plate is slideable.

5. The apparatus as set forth in claim 1 together with trim molding attached to said door frame flange, said trim molding having two spaced apart sections respectively terminating adjacent opposite ends of said bar lock, and supplemental trim molding attached to and movable with said bar lock and aligned with and forming a continuation of the trim molding of said flange when said bar lock is retracted, said confining means being concealed by said supplemental trim molding.

6. The apparatus as set forth in claim 4 in which said confining means also includes a series of projections extending outwardly from said flange, said bar lock plate including a series of elongated apertures through which said projections respectively extend, the ends of said slots determining the projected and retracted positions of said bar lock.

7. The apparatus as set forth in claim 6 together with trim molding attached to said door frame flange, said trim molding having two spaced apart sections respectively terminating adjacent opposite ends of said bar lock, and supplemental trim molding attached to and movable with said bar lock and aligned with and forming a continuation of the trim molding of said flange when said bar lock is retracted, said confining means being concealed by said supplemental trim molding.

8. The combination as set forth in claim 6 in which said projections are formed as knuckles on a backing plate extending behind the flange at the region of said bar lock, said knuckles extending through corresponding holes in said flange, said fulcrum member being threaded through said knuckles.

9. The combination as set forth in claim 8 together with trim molding attached to said door frame flange, said trim molding having two spaced apart sections respectively terminating adjacent opposite ends of said bar lock, and supplemental trim molding attached to and movable with said bar lock and aligned with and forming a continuation of the trim molding of said flange when said bar lock is retracted, said confining means being concealed by said supplemental trim molding.

10. In a metal door frame structure:

(a) a plurality of substantially channel shaped frame elements cut to frame the two sides and the top of a wall opening;
(b) a door hinged on one of the side frame elements;
(c) said frame elements having flanges faced to the inside of the door opening and substantially flush with the inside door surface;
(d) trim molding attached to said flanges, a section of trim molding along another of the frame elements being removed;
(e) an elongated structural bar lock extending and slidable along the flange at the region of the removed trim molding section;
(f) said elongaged bar lock having a series of guide apertures extending along the length of said bar lock and each elongated in the transverse direction;
(g) a series of projections extending frontally of said flange and through the guide apertures of said bar lock;
(h) a pin or rod extending through and mounted by said projections and overlying said bar lock to confine it for sliding movement against said flange;
(i) said guide apertures determining alternate limited positions of said bar lock in which said bar lock is projected over the edge of the door and in which the bar lock is retracted to clear the edge of the door; and
(j) a supplemental trim molding attached to said bar lock to conceal said bar lock and to provide a handle for operation of said bar lock.

11. The combination as set forth in claim 10 in which said projections are formed as knuckles on a backing plate extending behind the flange at the region of said bar lock, said knuckles extending through corresponding holes in said flange.

12. In a door frame structure:
(a) a plurality of substantially channel shaped frame elements cut to frame the two sides and top of a wall opening;
(b) a door hinged on one of the side frame elements;
(c) said frame elements having flanges faced to the inside of the door opening and substantially flush with the inside door surface;
(d) trim molding attached to said flanges, a seciton of trim molding along another of the frame elements being removed;
(e) an elongated spring steel bar lock plate extending along and slidable at the frame element flange at the region of the removed trim molding;
(f) said bar lock having a series of substantially rectangular guide openings all parallel to each other and arrayed along the length thereof;
(g) a backing plate extending behind the flange at the region of said bar lock plate, and having a series of knuckles extending through apertures in the flange to project frontally of the flange and through said guide openings, said knuckles having aligned openings; and
(h) a fulcrum pin or rod extending through and mounted by said aligned openings of said knuckles and overlying said bar lock plate to confine it for sliding movement against said flange, said guide openings cooperating with said knuckles to determine transverse movement of said bar lock plate between opposite limited positions in one of which said bar lock plate is projected over the edge of said door and in the other of which said bar lock plate is retracted to clear said door.

13. The combination as set forth in claim 11 together with a supplemental trim molding connection to said bar lock plate to conceal said knuckles and said fulcrum pin or rod, said supplemental trim molding providing a handle for movement of said bar lock plate, said supplemental trim molding conforming to the remaining trim molding and aligned therewith when said bar lock plate is in retracted position.

14. In a door structure including:
(a) a metal door frame defining a door opening for a building, said door frame having a flange faced to the inside of the door opening and generally paralleling the plane of the door opening;
(b) a door fitted to the door opening;
(c) hinge means located at one side of the door opening and attached to the corresponding side of the door for mounting the door for swinging movement;
(d) a main door lock located at the opposite side of the door;

the combination therewith of:
(e) an elongated bar lock extending along the flange at a place past which an edge of the door swings;
(f) means mounting the bar lock on said flange and confining the bar lock for sliding movement substantially parallel to the plane of the door opening retractably to project throughout its length over the edge of the door when the door is closed;
(g) said mounting means transmitting to the metal frame structure door opening pressure exerted on said bar lock; and
(h) means determining stable open and closed positions of said bar lock.

* * * * *